United States Patent [19]

McDonald

[11] Patent Number: 4,951,478

[45] Date of Patent: Aug. 28, 1990

[54] VARIABLE CAPACITY CONTROL VALVE

[75] Inventor: Larry K. McDonald, Canton, Mich.

[73] Assignee: Chrysler Corporation, Higland Park, Mich.

[21] Appl. No.: 426,632

[22] Filed: Oct. 24, 1989

[51] Int. Cl.[5] ..... F25B 41/04

[52] U.S. Cl. ..... 62/222; 62/528; 137/504; 138/45

[58] Field of Search ..... 62/511, 527, 528, 222; 138/45, 46; 137/504

[56] References Cited

U.S. PATENT DOCUMENTS

| | | | |
|---|---|---|---|
| 1,063,933 | 6/1913 | Keller | 138/46 |
| 2,181,416 | 11/1939 | Boles | 62/222 |
| 2,224,216 | 10/1940 | Coberly | 137/504 |
| 2,893,219 | 7/1959 | Eskin | 62/222 |
| 3,141,477 | 7/1964 | Campbell et al. | 138/45 |
| 3,431,944 | 3/1969 | Sakuma | 138/45 |
| 3,438,389 | 4/1969 | Lupin | 137/504 |
| 3,659,433 | 5/1972 | Shaw | 62/511 |
| 3,805,824 | 4/1974 | Robbins, Jr. | 137/504 |
| 3,952,535 | 4/1976 | Putman | 62/222 |
| 3,973,410 | 8/1976 | Putman et al. | 62/527 |
| 4,009,592 | 3/1977 | Boerger | 62/222 |
| 4,075,294 | 2/1978 | Saito et al. | 138/45 X |
| 4,263,787 | 4/1981 | Domingorena | 62/324.6 |
| 4,412,432 | 11/1983 | Brendel | 62/504 |
| 4,437,493 | 3/1984 | Okuda et al. | 138/45 |
| 4,633,681 | 1/1987 | Webber | 62/511 |

*Primary Examiner*—William E. Tapolcai
*Attorney, Agent, or Firm*—Kenneth H. MacLean, Jr.

[57] ABSTRACT

In an automobile air conditioning system, an improved orifice type expansion device includes a movable piston which supports an orifice tube so that the piston is moved in response to higher than normal condenser pressure towards a stationary plug member so that the resistance to flow is increased and thus a desirable low evaporator pressure and temperature is maintained.

2 Claims, 1 Drawing Sheet

VARIABLE CAPACITY CONTROL VALVE

BACKGROUND OF THE INVENTION

1. Field of Invention

The present invention relates generally to automobile air conditioning systems and specifically to a control valve for refrigerant entering an evaporator.

2. Description of the Related Art

For a considerable period of time, automobile air conditioning systems have used an orifice type control valve to regulate the flow of refrigerant into the evaporator. An orifice valve in its basic configuration is simply a short tube with a relatively small diameter bore. It functions much in the manner of a capillary tube expander long which has been long used in the stationary air conditioning art.

The basic orifice tube is effective in regulating flow to the evaporator under normal conditions. The flow through an orifice tube is a function of the subcooling of the liquid refrigerant entering the orifice as well as the pressure differential across the orifice tube. However when the operating conditions are severe such as when the environment is very hot, the condenser pressure rises undesirably. The pressure increase causes more flow through the orifice and this causes the evaporator pressure and the refrigerant's saturation temperature to increase. As a result, the evaporator efficiency decreases.

There have been previous attempts to increase the flexibility of orifice type valves to handle the aforesaid severe operating condition. An example is found in U.S. Pat. No. 4,009,592 to Boerger. The Boerger valve has a main orifice tube which moves in response to refrigerant pressure. The main orifice moves bi-directionally to alternately seat against a first additional orifice located at one end or a second orifice located at another end. Also, the main orifice may occupy a mid-position whereby both the first and second tubes are bypassed. This provides several combinations of resistance to fluid flow.

Another example of a variable control valve for fluid systems is found in the U.S. Pat. No. 3,805,824 to Robbins. The Robbins patent also discloses an orifice tube movable in response to pressure changes. The tube is reciprocal in a slightly larger tube blocked at one end and with an outlet spaced therefrom. As the orifice tube moves into the larger tube, the length of the flow path is increased. The purpose of this valve is to provide a controlled and constant rate of flow.

Still another example of a variable control valve is found in U.S. Pat. No. 3,431,944 to Sakuma. The Sakuma patent discloses a metering valve in which a fixed elongated needle is mounted in a cylindrical housing. A slide member having the form of an annulus is moved in the housing along the needle to provide variable fluid metering. The purpose of this valve is to provide a constant flow rate regardless of inlet pressure changes.

Another example of a valve with a movable orifice is U.S. Pat. No. 4,263,787 which allows bi-directional flow at different rates by movement of the orifice. Also, examples of control valves having orifices movable with respect to stationary members to effect a variable capacity are disclosed in U.S. Pat. Nos. 3,952,535; 3,973,410; and 4,412,432.

In addition, control valves using a movable member with respect to an orifice or an outlet are found in the following U.S. Pat. Nos.: 2,181,416; 3,659,433 and 4,633,681. The following disclose a distortable orifice member of rubber or the like: U.S. Pat. Nos. 2,893,219 and 3,141,477.

SUMMARY OF THE INVENTION

The subject fluid flow control valve for air conditioning systems utilizes the simplicity of the basic orifice type expander while including a simple refinement which is needed to handle severe environmental conditions. By supporting the orifice tube in a piston which is movable in a cylinder, the orifice and piston in one position for normal operations function like any other orifice control. However when the piston and orifice tube are moved by increased pressure to a different operating position corresponding to operation under severe conditions such as very high temperatures, the flow restrictive effect of the orifice can be increased as explained hereinafter.

A stationary cross-member having a solid plug portion aligned with the orifice tube is located to normally be spaced sufficiently from the orifice so that the flow restrictive effect of the orifice is unaffected. The solid plug portion has a flat end surface aligned normally to the orifice outlet so that when the piston and orifice move to toward the severe operating position the orifice outlet comes into closer spaced relation with the end surface. This significantly increases the flow resistance through the orifice.

The details as well as other features and advantages of preferred embodiments of this invention are set forth in the remainder of the specification and are shown in the drawings.

IN THE DRAWINGS

FIG. 1 is a sectioned perspective view of the flow control device with parts broken away to reveal structure; and FIG. 2 is a sectioned view of the device taken along section line 2—2 in FIG. 1 and looking in the direction of the arrows; and FIG. 3 is an elevational and sectioned view of the device in a first mode of operation exhibiting a normal resistance to fluid flow; and FIG. 4 is an elevational and sectioned view of the device in a second mode of operation exhibiting an increased resistance to fluid flow; and FIG. 5 is a schematic view of an automobile air conditioning system including the subject control valve.

DETAILED DESCRIPTION OF AN EMBODIMENT

Figure 5:
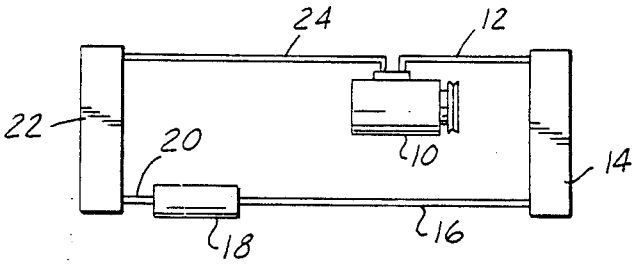

In FIGS. 1–5, an automobile air conditioning system with a specific flow control valve for refrigerant is shown. In FIG. 5, a refrigerant compressor 10 is illustrated. A conduit 12 extends from the outlet of the compressor 10 to an inlet of a condenser 14. A conduit 16 extends from an outlet of condenser 14 to the inlet end of a flow control device or valve 18. A conduit 20 extends from the outlet end of the device 18 to an inlet of an evaporator 22. A conduit 24 extends from the outlet of evaporator 22 to an inlet of the compressor 10 to complete the refrigerant flow cycle. The compressor 10 is driven by an automobile engine (not shown) as is conventional in the air conditioning art. Also not shown are fans and other devices associated with a conventional air conditioning system.

Not shown are control means to deactivate the compressor or otherwise limit evaporator temperature so that the evaporator will not freeze under certain conditions.

Referring to the other figures, the flow control device 18 is illustrated. Device 18 includes a hollow housing or enclosure 26 simply illustrated as a thin walled cylindrical tube with inlet end portion 28 and outlet end portion 30. The enclosure could take other forms. Enclosure 26 defines a cylindrical passage 32 therein. A cylindrical piston 34 is supported in the passage 32 in a manner permitting it to move in axial directions as is evident from the two different positions which piston 34 assumes in FIGS. 3 and 4. The piston 34 is sealingly supported in the passage 32 by an O-ring seal 36 in a groove 38. Thus, refrigerant flow between the enclosure and the piston is effectively prevented.

Figure 1:
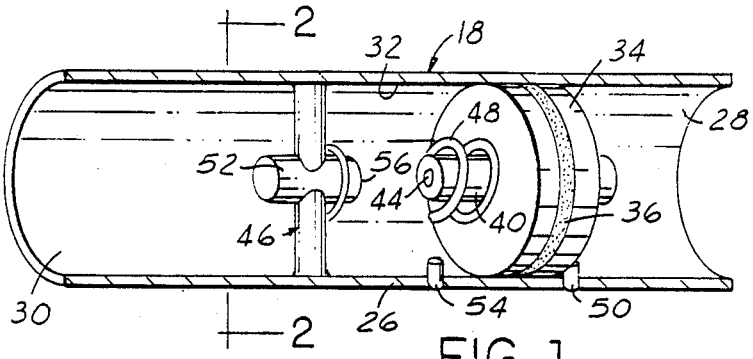
Figure 2:
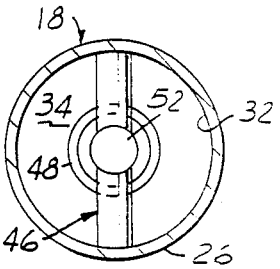

The piston 34 has a long but small diameter orifice passage 40 extending therethrough. The orifice passage could also be formed as a separate orifice tube member which is mounted in a central aperture of the piston 34. The passage has an inlet end portion 42 and an outlet end forming portion 44. Since the function and operation of orifice type control valves in air conditioning systems is already well known, applicant simply makes reference to the patents discussed earlier in this specification. Basically, the refrigerant flow through an orifice tube is a function of the liquid subcooling entering the orifice tube and the pressure differential across the orifice tube. Under normal (non-severe) operating conditions, the orifice is effective to introduce a desired quantity of liquid refrigerant into the evaporator from the condenser so that a desired cold temperature of most of its surface area is achieved. Thus, the diameter and length of the orifice is selected to satisfy these normal conditions. Under these conditions the resistance of the orifice tube alone which is produced when it is in the rightward position shown in FIGS. 1 and 2 is fine. More will be said about severe operating conditions later in the specification.

Figure 3:
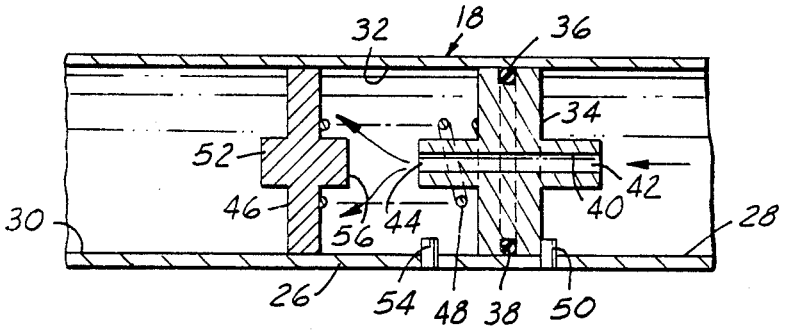
Figure 4:
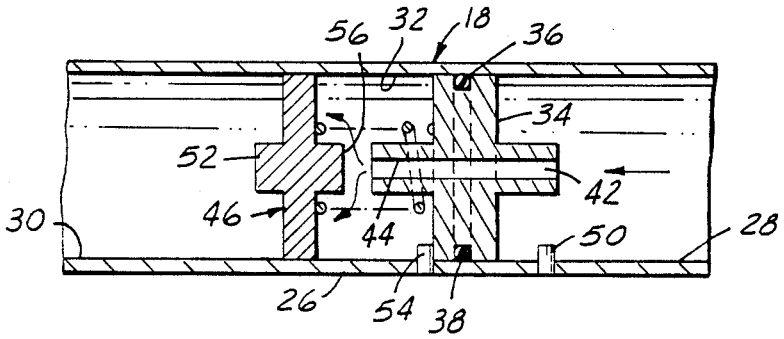

A stationary portion or member 46 extends across the passage 32 of the enclosure 26 as illustrated in FIGS. 1–4. Member 46 is located generally downstream of piston 34 and has a thin construction so it does not inhibit or interfere with fluid flow through orifice 40 when the piston is in the upstream or rightward position shown in FIGS. 1 and 3. A light coil spring 48 extends from stationary member 46 to the piston 34 to normally urge the piston to the right. A stop member 50 of the enclosure limits movement of the piston to the right as best shown in FIG. 3. The rightward end portion of the spring 48 encircles the outlet end portion 44 of the orifice tube so that a centrally distributed spring force is applied to the piston 34. The leftward end portion of the spring 48 encircles a centrally positioned axially extending member or portion 52 of the stationary member 46. Thus, the spring 48 is centered in the passage 32.

Under severe operating conditions (very hot environment), the condenser pressure will increase greatly. With the orifice tube in the position shown in FIGS. 1 and 3, refrigerant flow through the orifice will increase undesirably due to the increase in inlet pressure to the orifice. As a result of the increased flow, the evaporator pressure increases. Also, a result is an increase in the saturation temperature of refrigerant in the evaporator. We know that the difference between evaporator inlet temperature and the evaporator saturation temperature is proportional to the heat exchanged between the refrigerant in the evaporator and the air flowing over the evaporator. Thus, the increase in saturation temperature decreases the heat exchange under these severe conditions. An improvement is made if the orifice is made more restrictive under these severe conditions.

The subject device provides a simple means to add more restriction to the orifice under conditions of abnormally high condenser pressure. Increasing condenser pressures create a force to the left on the piston 34 which eventually urge it to the position shown in FIG. 4. A second stop member 54 of the enclosure 26 limits leftward movement of the piston. In the leftward position, a flat end surface 56 is closely spaced and aligned with the outlet 44 of the orifice tube 40. This effectively increases the total resistance to flow through the orifice and limits evaporator pressure under these severe operating conditions.

Although only a single embodiment of the invention is shown in the drawings and described in detail heretofore, it is clear that modifications may be contemplated without falling outside the scope of the invention as claimed hereafter.

I claim:

1. An improved fluid flow control device comprising: a hollow enclosure having an inlet end portion and an outlet end portion; the enclosure defining a cylindrical passage extending between the inlet and outlet end portions; piston means supported in the cylindrical passage in a manner permitting movement axially in the cylindrical passage, the piston means being sealed with respect to the enclosure to prohibit fluid flow between it and the enclosure; an orifice tube extending through the piston and defining a small diameter orifice passage with inlet and outlet end portions for controlled fluid flow through the piston; stationary means supported across the cylindrical passage and positioned downstream of the piston and orifice tube, the stationary means further having a substantially flat surface normal to and aligned with the orifice tube so that fluid flow exiting from the orifice outlet is directed toward the end surface; yieldable spring means extending between the piston means and the stationary means urging them away from one another, whereby under normal operating conditions the spring means positions the outlet end portion of the orifice away from the end surface so that flow resistance is substantially unaffected by the end surface but is established solely by the resistance of the orifice tube itself and whereby under severe operating conditions differential forces acting on the piston move it against the force of the spring means to decrease the distance between the outlet of the orifice and the end surface sufficiently to add flow resistance to the resistance of the orifice and resultantly decrease the flow rate through the device; piston stop means located downstream of the piston means to limit movement of the piston means toward the end surface of the stationary means whereby the stop means permits the outlet portion of the orifice to closely approach but not engage the end surface thereby increasing flow resistance through the device.

2. In an automobile air conditioning system, an improved refrigerant flow controlling device located between a condenser and an evaporator to restrict the flow of refrigerant into the evaporator from a pressurized condenser thereby maintaining evaporator internal pressure at a desired low level even when condenser pressure increases, the improved device comprising: hollow enclosure means having fluid inlet and outlet portions separated by a cylindrical passage; piston means supported within the cylindrical passage for reciprocal movement therein, the piston means sealingly engaging the enclosure so that refrigerant is prevented from passing between the enclosure and pistons means; an orifice tube with a small passage extending through the piston means for normally regulating the passage of refrigerant from the condenser to the evaporator, the orifice passage having an outlet end portion located to one side of the piston means; stationary means extending across the cylindrical passage and spaced between the piston means and the outlet portion of the enclosure means, the stationary means defining a flat end surface extending in a plane normal to the axis of the cylindrical passage and with the end surface generally aligned with the axis of the orifice passage so that refrigerant flow exiting the orifice passage is directed toward the end surface; a compression coil type spring extending between the piston means and the stationary means urging them away from one another, whereby under normal condenser pressures corresponding to normal ambient temperatures the spring positions the outlet end portion of the orifice sufficiently far away from the end surface so that flow resistance is substantially unaffected by the end surface but is established solely by the orifice resistance itself and whereby under abnormally increased condenser pressures corresponding to the abnormally hot ambient temperatures a sufficient differential pressure force acting on the piston in opposition to the spring moves the piston so as to decrease the spacing between the outlet of the orifice and the end surface sufficiently to create a flow resistance in addition to the resistance of the orifice and resultantly decrease the flow rate through the device; piston stop means located downstream of the piston means to limit movement of the piston means toward the end surface of the stationary means whereby the stop means permits the outlet portion of the orifice to closely approach but not engage the end surface thereby increasing flow resistance through the device.

* * * * *